United States Patent [19]

Haka

[11] 4,164,918

[45] Aug. 21, 1979

[54] EXHAUST GAS RECIRCULATION CONTROL

[75] Inventor: Raymond J. Haka, Rochester, Mich.

[73] Assignee: General Motors Corporation, Detroit, Mich.

[21] Appl. No.: 879,781

[22] Filed: Feb. 21, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,762,384 | 1/1972 | Day et al. | 123/119 A |
| 3,783,848 | 1/1974 | Ranft et al. | 123/119 A |
| 3,791,360 | 2/1974 | Rieger | 123/119 A |
| 3,799,131 | 3/1974 | Bolton | 123/119 A |
| 3,800,765 | 2/1974 | Thompson | 123/119 A |
| 3,802,402 | 4/1974 | Swatman | 123/119 A |
| 3,834,363 | 10/1974 | Goto et al. | 123/119 A |
| 3,834,366 | 9/1974 | Kingsbury | 123/119 A |
| 3,844,261 | 10/1974 | Garcea | 123/119 A |
| 3,880,129 | 4/1975 | Hollis, Jr. | 123/119 A |
| 3,881,456 | 5/1975 | Nohira et al. | 123/119 A |
| 3,896,777 | 7/1975 | Masaki | 123/119 A |
| 3,928,966 | 12/1975 | Goto et al. | 123/119 A X |
| 3,931,813 | 1/1976 | Horie et al. | 123/119 A |
| 3,974,807 | 8/1976 | Nohira et al. | 123/119 A |
| 3,982,515 | 9/1976 | Bradshaw | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,044,735 | 8/1977 | Sumiyoshi | 123/119 A |
| 4,069,797 | 1/1978 | Nohira et al. | 123/119 A |
| 4,069,798 | 1/1978 | Thornburgh | 123/119 A |
| 4,079,710 | 3/1978 | Moriya et al. | 123/119 A |

FOREIGN PATENT DOCUMENTS

| | | | |
|---|---|---|---|
| 1380046 | 1/1971 | United Kingdom | 123/119 A |

*Primary Examiner*—Wendell E. Burns

*Attorney, Agent, or Firm*—C. K. Veenstra

[57] ABSTRACT

A transducer regulates an operating pressure which positions an exhaust gas recirculation control valve pintle to provide exhaust gas recirculation at rates which maintain the pressure in the recirculation passage upstream of the valve pintle equal to a reference pressure; exhaust gas recirculation thus varies with engine exhaust backpressure and accordingly is substantially proportional to induction air flow. The transducer has a pair of current carrying coils which create a bias affecting the reference pressure; the current is adjusted for selected operating conditions to change the reference pressure and thereby change the proportion of exhaust gas recirculation to induction air flow.

8 Claims, 4 Drawing Figures

EXHAUST GAS RECIRCULATION CONTROL

This invention relates to control of exhaust gas recirculation and provides a novel assembly for controlling exhaust gas recirculation in proportion to induction air flow and for changing the proportion for selected operating conditions.

Recirculation of exhaust gases has been developed as a method for inhibiting formation of oxides of nitrogen during the combustion process in an internal combustion engine. In general, it is desired to recirculate exhaust gases at a rate proportional to the rate of engine induction air flow. To accomplish that purpose, exhaust gas circulation (EGR) control assemblies have included an EGR control valve pintle positioned to provide exhaust gas recirculation at rates which maintain the control pressure in the EGR passage upstream of the pintle equal to a constant reference pressure. Recirculation of exhaust gases has thus been varied with exhaust backpressure, which in turn varies as a function of induction air flow, to provide exhaust gas recirculation substantially proportional to induction air flow.

To fully appreciate the advantages of this invention, it also must be recognized that such prior EGR control assemblies generally included a transducer for regulating a subatmospheric operating pressure by which the control valve pintle was positioned. The transducer employed an air bleed valve member to regulate the operating pressure —opening an air bleed to increase the operating pressure which caused the control valve pintle to reduce exhaust gas recirculation when the induction air flow (and thus the engine exhaust backpressure) decreased and the control pressure accordingly started to fall below the reference pressure, and closing the air bleed which reduced the operating pressure and caused the control valve pintle to increase exhaust gas recirculation when the induction air flow (and thus the engine exhaust backpressure) increased and the control pressure accordingly started to rise above the reference pressure. The bleed valve was carried on a diaphragm subjected on one side to the control pressure in the EGR passage and balanced by atmospheric pressure on the opposite side and by the bias of a spring; the combination of atmospheric pressure and the spring bias formed the constant reference pressure.

Various controls have been used to cancel the operating pressure used by such assemblies and thus entirely preclude exhaust gas recirculation under conditions such as idle, wide open throttle and low temperature operation. For other selected conditions such as heavy load operation, however, it may be desired to provide exhaust gas recirculation in relatively high proportion to induction air flow, while for conditions such as light load operation it may be desired to provide exhaust gas recirculation in relatively low proportion to induction air flow. But with the prior EGR control assemblies, the proportion could be changed only by using a third valve element to adjust the area of the EGR passage upstream of the control valve pintle.

This invention provides an improved EGR control assembly based on the prior EGR controls but which allows changes in the proportion of exhaust gases recirculated without the use of a third valve element. With the improved EGR control of this invention, the reference pressure is adjusted when a change in the proportion is desired; the control valve pintle then moves to the position required to provide the new rates of exhaust gas recirculation necessary to establish a control pressure equal to the adjusted reference pressure. Thus when a lower proportion is required, the reference pressure is increased to effect an increase in the control pressure, while when a higher proportion is required, the reference pressure is reduced to effect a decrease in the control pressure.

From the foregoing, it may be understood that the improved EGR control of this invention provides exhaust gas recirculation in proportion to induction air flow and changes the proportion by changing the reference pressure to effect a change in the control pressure; the prior proposals could change the proportion only by using an additional valve element to adjust the area of the EGR passage upstream of the control valve.

In the preferred embodiment of this invention, the electromagnetic force between a pair of current carrying coils is used as a bias which, in combination with atmospheric pressure, forms the reference pressure. Current in one or both of the coils may be increased or decreased to vary the bias affecting the reference pressure, and current in one of the coils may be reversed so that the bias is either added to or subtracted from atmospheric pressure.

The details as well as other features and advantages of this invention are set forth in the remainder of the specification and are shown in the drawings, in which:

FIG. 1 is a schematic view of an exhaust gas recirculation control system employing a preferred embodiment of this invention in which the transducer is separate from the control valve;

FIG. 2 graphically illustrates the operating characteristics of this invention;

Figure 1:
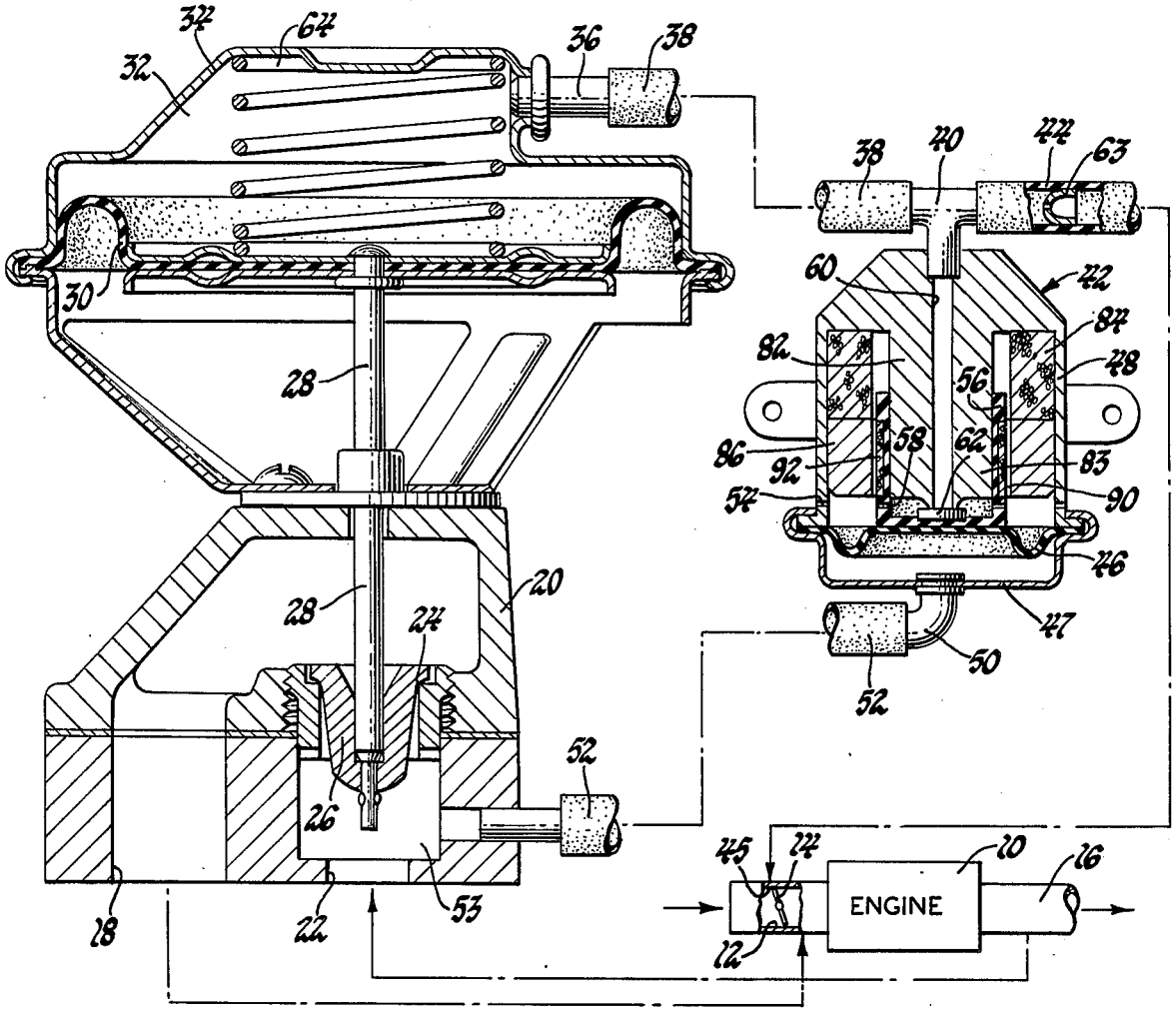

Referring first to FIG. 1, an internal combustion engine 10 has an air induction passage 12, a throttle 14 controlling induction air flow through passage 12, and an exhaust passage 16. An exhaust gas recirculation (EGR) passage 18 extends from exhaust passage 16 through an EGR valve body 20 to induction passage 12 downstream of throttle 14.

An orifice 22 is disposed in EGR passage 18 upstream of a valve seat 24. A control valve pintle 26 is associated with valve seat 24 and has a stem 28 extending to an operating diaphragm 30. Diaphragm 30 forms part of an operating pressure chamber 32 closed by a cover 34.

A fitting on cover 34 is connected through a hose 38 to a T-fitting 40 forming part of a transducer 42. T-fitting 40 in turn is connected through a hose 44 to a port 45 in induction passage 12 which is traversed by thottle 14. Accordingly, operating pressure chamber 32 is exposed to the subatmospheric induction passage pressure downstream of throttle 14 during open throttle operation and to the substantially atmospheric pressure upstream of throttle 14 during idle and other closed throttle modes of operation.

Transducer 42 has a control diaphragm 46 clamped between a cover 47 and a transducer housing 48. A fitting 50 on cover 47 is connected through a hose 52 to sense the control pressure in the control pressure zone 53 of EGR passage 18 intermediate orifice 22 and a valve seat 24, thus subjecting the control pressure chamber beneath diaphragm 46 to the control pressure. The chamber above diaphragm 46 is exposed to atmospheric pressure through openings 54 in housing 48. Accordingly, diaphragm 46 is pushed upwardly by a pressure differential when the control pressure exceeds the reference established by atmospheric pressure and downwardly when the control pressure is less than the atmospheric pressure reference.

Diaphragm 46 carries a cup 56 having openings 58 that allow air flow through cup 56 to a bleed passage 60 which extends to T-fitting 40. A bleed valve disc 62 is carried on diaphragm 46 to control flow through bleed passage 60.

Chamber 32 creates an operating pressure from the subatmospheric induction passage pressure sensed through an aperture 63 in hose 44 and the atmospheric pressure sensed through bleed passage 60. When the control pressure exceeds atmospheric pressure, diaphragm 46 lifts bleed valve 62 to obstruct air flow through bleed passage 60. The subatmospheric pressure signal sensed through aperture 63 thereupon reduces in the operating pressure in chamber 32, and diaphragm 30 then lifts valve pintle 26 against the force of a spring 64 to increase the area between control valve pintle 26 and valve seat 24, thereby to increase recirculation of exhaust gases through EGR passage 18 and reduce the central pressure in zone 53. When the control pressure drops below atmospheric pressure, diaphragm 46 displaces bleed valve 62 away from bleed passage 60 and the resulting air flow through bleed passage 60 increases the operating pressure in chamber 32; accordingly, spring 64 displaces valve pintle 26 toward valve seat 24 to reduce the area therebetween and thereby reduce recirculation of exhaust gases through passage 18 and increase the control pressure in zone 53. As a result, control valve pintle 26 is positioned to provide exhaust gas recirculation at rates which maintain the control pressure in zone 53 substantially constant.

When the control pressure is constant, the flow of exhaust gases through the fixed area orifice 22 varies as a function of the exhaust backpressure in passage 16. Since the exhaust backpressure is a function of the flow through engine 10—that is, a function of the flow through exhaust passage 16 and thus the flow through air induction passage 12—the flow of exhaust gases through EGR passage 18 will be proportional to the flow through air induction passage 12.

Figure 2:
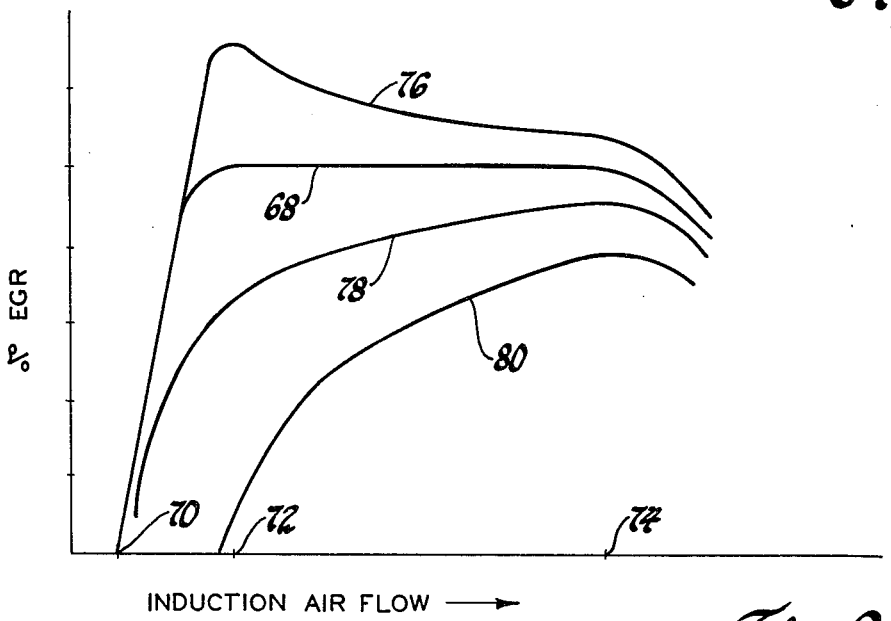

FIG. 2 graphically illustrates the proportion of exhaust gases recirculated as induction air flow increases, and line 68 shows the proportion when the control pressure in zone 53 is maintained equal to atmospheric pressure. To the left of the point 70 on the horizontal axis, throttle 14 is closed and no subatmospheric pressure is delivered to chamber 32 to lift diaphragm 30 and pintle 26. Between point 70 and point 72, throttle 14 traverses port 45 to decrease the pressure delivered to chamber 32, allowing diaphragm 30 to displace pintle 26 from valve seat 24. To the right of point 72, the control pressure in zone 53 equals atmospheric pressure and exhaust gas recirculation is exactly proportional to induction air flow. Beyond point 74, however, the induction passage pressure rises toward atmospheric pressure, preventing diaphragm 30 from retracting pintle 26 sufficiently to maintain that proportion, and the proportion accordingly is reduced as desired for high induction air flow operation.

In some applications it may be desired to vary the proportion of exhaust gases recirculated above or below line 68 for selected operating conditions. This may be achieved by varying the control pressure: when the control pressure is less than atmospheric an increased proportion of exhaust gases will be recirculated as shown by the line 76 in FIG. 2, and when the control pressure is greater than atmospheric a lesser proportion of exhaust gases will be recirculated as shown by the lines 78 and 80 in FIG. 2.

To vary the control pressure, this invention provides means to vary the reference pressure otherwise established by atmospheric pressure alone. In transducer 42, bleed passage 60 extends through a core member 82 having its lower end 83 disposed adjacent diaphragm 46. Core member 82 is disposed within a stationary coil 84, while an annular member 86 is disposed transversely under coil 84 and surrounds the lower end 83 of core member 82 to define a cylindrical air gap 90 therebetween. Cup 56 extends through air gap 90 and carries a moving coil 92 for axial movement concentric with coil 84.

When current is supplied to coils 84 and 92, an electromagnetic force is created between the coils. The electromagnetic force is applied through cup 56 as a bias on diaphragm 46 and bleed valve 62, and the bias is combined with the atmospheric pressure above diaphragm 46 to form the reference pressure on diaphragm 46.

Figure 3:
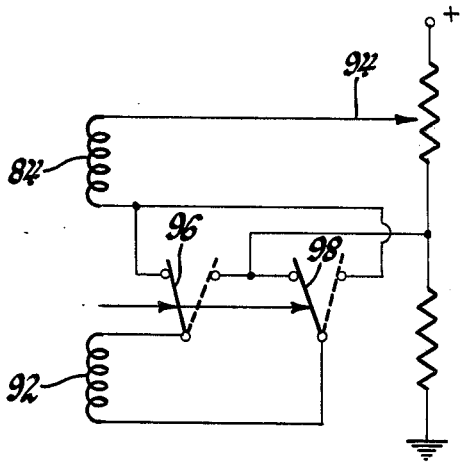
FIG. 3 is a diagram of a circuit for supplying current to the coils.

FIG. 3 illustrates one of many possible circuits for supplying current to coils 84 and 92. As the potentiometer arm 94 is moved upwardly to increase current in coils 84 and 92, the increasing electromagnetic force between coils 84 and 92 increases the reference pressure. Accordingly, diaphragm 46 displaces bleed valve 62 from the end 83 of core member 82 to allow increased air flow through bleed passage 60; the resulting increase in the operating pressure in chamber 32 causes spring 64 to displace valve pintle 26 toward valve seat 24, reducing flow through EGR passage 18 until the control pressure equals the increased reference pressure.

Exhaust gases are recirculated from the exhaust passage 16 to and through zone 53, and the rate of exhaust gas recirculation accordingly is a function of the difference between the engine exhaust backpressure in passage 16 and the control pressure in zone 53. As induction air flow and exhaust backpressure increase, the control pressure in zone 53 starts to rise above the reference pressure; transducer diaphragm 46 then seats bleed valve 62 across bleed passage 60 to reduce the operating pressure in chamber 32, and diaphragm 30 lifts valve pintle 26 to increase recirculation of exhaust gases. Exhaust gas recirculation is thus proportioned to induction air flow. Upon an increase in the current in coils 84 and 92, the reference and control pressures increase and the proportion of exhaust gas recirculation to induction air flow is decreased as indicated by lines 78 and 80 in FIG. 2. Adjustment of current in coils 84 and 92 thus allows control over the proportion of exhaust gas recirculation to induction air flow.

It will be appreciated, of course, that adjustment of current in only one of the coils would be sufficient to vary the electromagnetic force between coils 84 and 92.

In some applications it may be desired to change the control pressure from above atmospheric pressure to below atmospheric pressure. To achieve that purpose, switches 96 and 98 are moved from the solid line position to the dotted line position as shown in FIG. 3, thus reversing the direction of current in coil 92. The bias resulting from the electromagnetic force between coils 84 and 92 is then subtracted from, rather than added to, atmospheric pressure to form a reference pressure which is lower than, rather than higher than, atmospheric pressure. Such a reduction in the reference and control pressures causes a corresponding increase in the proportion of exhaust gas recirculation to induction air flow as indicated by line 76 in FIG. 2.

Figure 4:
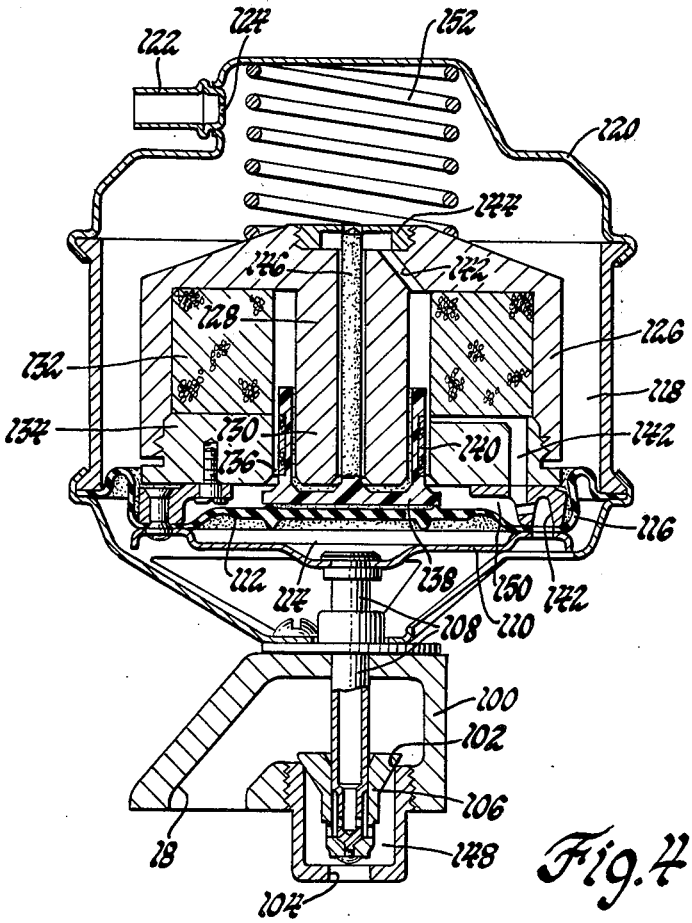
FIG. 4 is a vertical sectional view of another embodiment of this invention in which the transducer is combined with the control valve in an integrated assembly.

FIG. 4 illustrates another embodiment of this EGR control assembly in which the transducer is combined with the control valve in an integrated assembly. Referring to FIG. 4, EGR passage 18 extends through a valve body 100 having a valve seat 102 and an orifice 104. A valve pintle 106 associated with valve seat 102 is mounted on a valve stem 108 which is secured to a plate 110. Plate 110 is secured to a diaphragm 112 to define a control pressure chamber 114 therebetween. Diaphragm 112 has an outer annulus 116 which forms an operating pressure chamber 118 with a cover 120. Cover 120 has a fitting 122 including and aperture 124 for sensing the pressure at port 45 in induction passage 12.

A transducer body 126 is secured to plate 110 and has a core member 128 extending downwardly so that its lower end 130 is adjacent diaphragm 112. A coil 132 surrounds core member 128. An annular member 134 extends transversely under coil 132 and defines an air gap 136 with the lower end 130 of core member 128. A cup 138 is secured to diaphragm 112 and carries a moving coil 140 for concentric axial movement in air gap 136.

An air bleed passage 142 opens through plate 110, diaphragm 112, annular member 134 and transducer body 126 to an air bleed aperture member 144 threaded into the top of transducer body 126. A bleed valve member 146, shown here as part of cup 138, extends from diaphragm 112 to control flow through aperture member 144.

In operation, the control pressure in the zone 148 of EGR passage 18 between orifice 104 and pintle 106 is applied to chamber 114 through the hollow valve stem 108. When the control pressure in chamber 114 is greater than the atmospheric pressure in a chamber 150 above diaphragm 112, diaphragm 112 lifts valve member 146 into aperture member 144 to reduce air flow through bleed passage 142. The operating pressure in chamber 118 is then reduced by the subatmospheric induction passage pressure sensed through orifice 124, and diaphragm annulus 116 lifts plate 110, valve stem 108 and valve pintle 106 against the bias of a spring 152 to increase recirculation of exhaust gases. When the control pressure in chamber 114 is less than the atmospheric pressure in chamber 150, diaphragm 112 lowers valve member 146 from aperture member 144 to increase air flow through bleed passage 142. The operating pressure in chamber 118 is then increased, and spring 152 lowers plate 110, valve stem 108 and valve pintle 106 to reduce recirculation of exhaust gases. The control pressure in zone 148 is thus maintained equal to atmospheric pressure and exhaust gas recirculation is proportional to induction air flow.

The electromagnetic force between coils 132 and 140 which results when current is supplied to the coils is applied to diaphragm 112 as a bias, and the reference pressure on diaphragm 112 is thereby modified either above or below atmospheric pressure. The assembly will control exhaust gas recirculation so that the control pressure is maintained equal to the reference pressure and the desired proportion is established between exhaust gas recirculation and induction air flow.

The embodiments of the invention in which an exclusive property or privilege is claimed are defined as follows:

1. An exhaust gas recirculation control assembly for an engine having an induction passage for induction air flow, an exhaust passage, and an exhaust gas recirculation passage interconnecting said exhaust and induction passages, said assembly comprising a valve for controlling exhaust gas recirculation through said recirculation passage, a coil, a member electromagnetically responsive to current in said coil for creating a reference pressure, and means operating said valve to provide exhaust gas recirculation at rates which maintain a control pressure in said recirculation passage equal to said reference pressure and thus provide exhaust gas recirculation substantially proportional to induction air flow, and wherein current in said coil may be adjusted to change said reference pressure and thereby change said control pressure to effect a change in the proportion of exhaust gas recirculation to induction air flow.

2. An exhaust gas recirculation control assembly for an engine having an induction passage for induction air flow, an exhaust passage, and an exhaust gas recirculation passage interconnecting said exhaust and induction passages, said assembly comprising a valve for controlling exhaust gas recirculation through said recirculation passage, a stationary coil, a moving coil disposed for concentric movement with respect to said stationary coil and responsive to current in said coils for creating a reference pressure, and means operating said control valve to provide exhaust gas recirculation at rates which maintain a control pressure in said recirculation passage equal to said reference pressure and thus provide exhaust gas recirculation substantially proportional to induction air flow, and wherein current in at least one of said coils may be adjusted to change said reference pressure and thereby change said control pressure to effect a change in the proportion of exhaust gas recirculation to induction air flow.

3. An exhaust gas recirculation control assembly for an engine having an induction passage for induction air flow, an exhaust passage, and an exhaust gas recirculation passage interconnecting said exhaust and induction passages, said assembly comprising a control valve positioned to produce an exhaust gas recirculation area in said recirculation passage in accordance with an operating pressure, a coil, a member electromagnetically responsive to current in said coil for creating a reference pressure, and a valve carried by either said coil or said member for regulating said operating pressure in response to a deviation of a control pressure in said recirculation passage from said reference pressure, whereby said control valve is positioned to provide exhaust gas recirculation through said recirculation passage at rates which maintain said control pressure equal to said reference pressure and thus provide exhaust gas recirculation substantially proportional to induction air flow, and wherein current in said coil may be adjusted to change said reference pressure and thereby change said control pressure to effect a change in the proportion of exhaust gas recirculation to induction air flow.

4. An exhaust gas recirculation control assembly for an engine having an induction passage for induction air flow, an exhaust passage, and an exhaust gas recirculation passage interconnecting said exhaust and induction passages, said assembly comprising a control valve positioned to produce an exhaust gas recirculation area in said recirculation passage in accordance with an operating pressure, a stationary coil, a moving coil disposed for concentric movement with respect to said stationary coil and responsive to current in said coils for creating a reference pressure, and a valve carried by said moving coil for regulating said operating pressure in response to a deviation of a control pressure in said recirculation passage from said reference pressure, whereby said control valve is positioned to provide exhaust gas recirculation through said recirculation passage to rates which maintain said control pressure equal to said reference pressure and thus provide exhaust gas recirculation substantially proportional to induction air flow, and wherein current in at least one of said coils may be adjusted to change said reference pressure and thereby change said control pressure to effect a change in the proportion of exhaust gas recirculation to induction air flow.

5. An exhaust gas recirculation control assembly for an engine having an induction passage for induction air flow, an exhaust passage, and an exhaust gas recirculation passage interconnecting said exhaust and induction passages, said assembly comprising a diaphragm defining a portion of an operating pressure chamber, said chamber having an aperture for sensing a subatmospheric pressure signal and also having an air bleed and combining the pressures sensed through said aperture and said bleed to form an operating pressure, a control valve positioned by said diaphragm to produce an exhaust gas recirculation area in said recirculation passage in inverse relation to said operating pressure, a control diaphragm defining a portion of a control pressure chamber having means for sensing the pressure in a zone of said recirculation passage upstream of said control valve, a stationary coil, a moving coil carried by said control diaphragm for concentric movement with respect to said stationary coil and responsive to current in said coils for creating a reference pressure on said control diaphragm opposing the control pressure in said control pressure chamber, and a bleed valve positioned by said control diaphragm to obstruct air flow through said bleed when said control pressure exceeds said reference pressure, whereby said control valve is positioned to provide exhaust gas recirculation through said recirculation passage at rates which establish the pressure in said zone necessary to maintain said control pressure equal to said reference pressure and thus provide exhaust gas recirculation substantially proportional to induction air flow, and wherein current in at least one of said coils may be adjusted to change said reference pressure and thereby change said control pressure to effect a change in the proportion of exhaust gas recirculation to induction air flow.

6. An exhaust gas recirculation control assembly for an engine having an induction passage for induction air flow, an exhaust passage, and an exhaust gas recirculation passage interconnecting said exhaust and induction passages, said assembly comprising a diaphragm defining a portion of an operating pressure chamber, said chamber having an aperture for sensing a subatmospheric pressure signal and also having an air bleed and combining the pressures sensed through said aperture and said bleed to form an operating pressure, a control valve positioned by said diaphragm to produce an exhaust gas recirculation area in said recirculation passage in inverse relation to said operating pressure, a control diaphragm defining a portion of a control pressure chamber having means for sensing the pressure in a zone of said recirculation passage upstream of said control valve, an outer coil, a core member extending axially through said outer coil and having one end terminating adjacent said control diaphragm, an annular member extending transversely over one end of said coil and surrounding said end of said core member to define an air gap therebetween, an inner coil carried by said control diaphragm for axial movement in said air gap and responsive to current in said coils for creating a reference pressure on said control diaphragm opposing the control pressure in said control pressure chamber, said air bleed extending through said core member, and a bleed valve positioned by said control diaphragm to obstruct air flow through said bleed when said control pressure exceeds said reference pressure, whereby said control valve is positioned to provide exhaust gas recirculation through said recirculation passage at rates which establish the pressure in said zone necessary to maintain said control pressure equal to said reference pressure and thus provide exhaust gas recirculation substantially proportional to induction air flow, and wherein current in at least one of said coils may be adjusted to change said reference pressure and thereby change said control pressure to effect a change in the proportion of exhaust gas recirculation to induction air flow.

7. An exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said air bleed to form an operating pressure, and a control valve in said recirculation passage and positioned by said diaphragm to produce an exhaust gas recirculation area in inverse relation to said operating pressure, said assembly comprising a coil, a member electromagnetically responsive to current in said coil for creating a reference pressure, a control diaphragm defining a portion of a control pressure chamber having means for sensing the pressure in a zone of said recirculation passage and carrying either said coil or said member, and a bleed valve positioned by said control diaphragm for obstructing flow through said bleed when the control pressure in said control pressure chamber exceeds said reference pressure, whereby said control valve may be positioned to provide exhaust gas recirculation at rates which establish the pressure in said zone necessary to maintain said control pressure equal to said reference pressure and thus provide exhaust gas recirculation as a proportion of induction air flow with said proportion being ruled by the current in said coil.

8. An improvement in an exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage and positioned by said diaphragm to produce an exhaust gas recirculation area in inverse relation to said operating pressure, a control diaphragm defining a portion of a control pressure chamber having means for sensing the pressure in a zone of said recirculation passage, and a bleed valve positioned by said control diaphragm to obstruct flow through said bleed when the control pressure in said control pressure chamber exceeds a reference pressure, said improvement comprising a coil and a member electromagnetically responsive to current in said coil for creating a force contributing to said reference pressure, whereby said control valve may be positioned to provide exhaust gas recirculation at rates which establish the pressure in said zone necessary to maintain said control pressure equal to said reference pressure and thus provide exhaust gas recirculation as a proportion of induction air flow with said proportion being ruled by the current in said coil.

* * * * *